United States Patent [19]

Graff

[11] 4,053,129

[45] Oct. 11, 1977

[54] GLIDING CHAIR SYSTEM

[76] Inventor: Vernon D. Graff, P.O. Box 1410, Edmond, Okla. 73034

[21] Appl. No.: 745,616

[22] Filed: Nov. 29, 1976

[51] Int. Cl.[2] ..... F16M 11/20

[52] U.S. Cl. ..... 248/188.7; 16/42 R; 16/47; 248/188.3; 280/677

[58] Field of Search ..... 16/18 B, 42 R, 42 T, 16/47, 48; 248/188.2, 188.3, 188.7; 280/79.1 R, 79.1 A, 104, 676, 677

[56] References Cited

U.S. PATENT DOCUMENTS

| | | | |
|---|---|---|---|
| 1,603,876 | 10/1926 | Shapard | 16/42 T |
| 2,490,956 | 12/1949 | Freund | 16/42 R X |
| 2,895,160 | 7/1959 | Clifton | 16/47 |
| 3,148,855 | 9/1964 | Hamilton | 248/188.7 |

*Primary Examiner*—James C. Mitchell
*Attorney, Agent, or Firm*—Alter and Weiss

[57] ABSTRACT

An improved gliding chair system for use in residential and commercial applications which provides facilitated gliding movement over non-smooth surfaces, such as carpets, without the need for area chair mats. Lever assemblies attached to the chairs legs automatically distribute the weight of the chair and its user as desired to a greater number of support locations, and in cooperation with various gliding devices, imparts a facilitated gliding action on such surfaces.

13 Claims, 10 Drawing Figures

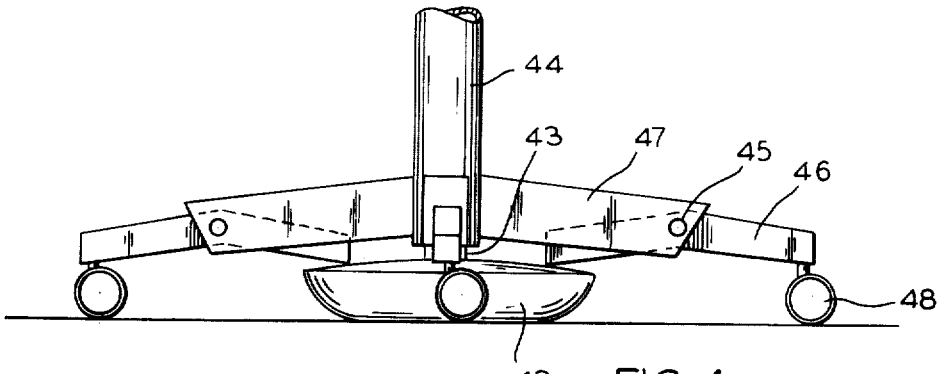
FIG. 4
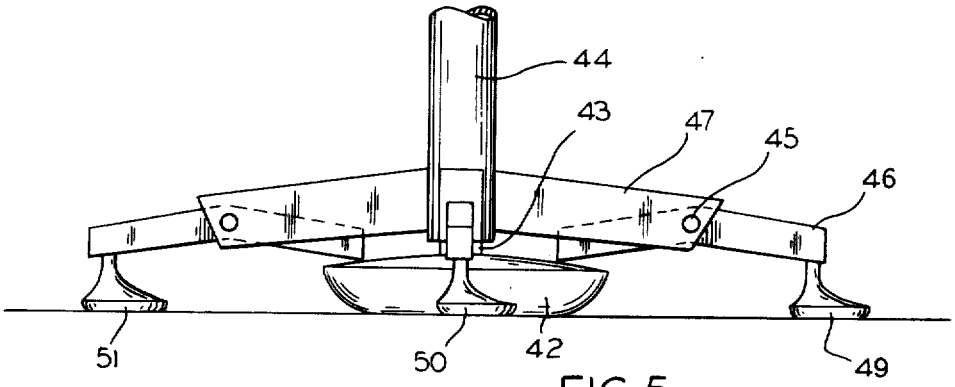
FIG. 5
FIG. 6
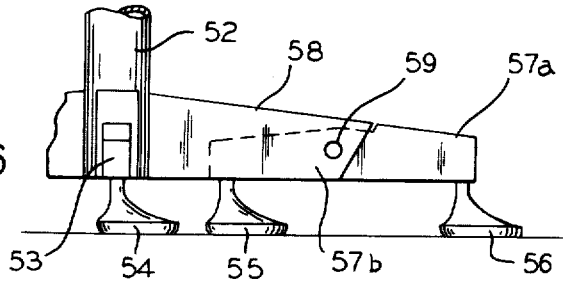
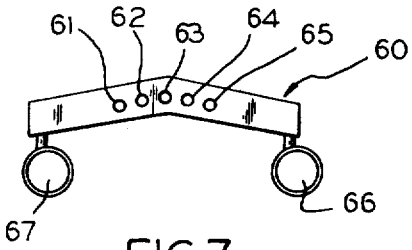
FIG. 7
FIG. 9
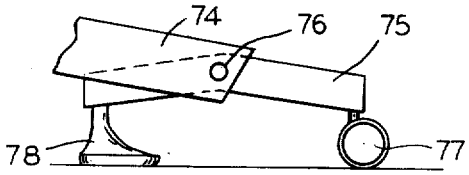
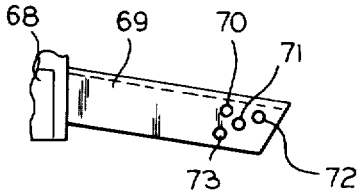
FIG. 8
FIG. 10
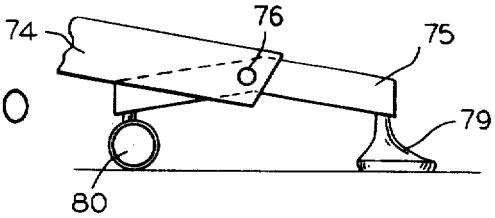

GLIDING CHAIR SYSTEM

BACKGROUND OF THE INVENTION

The present invention relates, in general, to seating furniture and in particular to a gliding chair system for use in commercial and residential applications.

Over the years various types of gliding and mobile chair assemblies have been developed, primarily for use in an office, as well as at home. The majority of the conventional seating apparatus utilize caster assemblies, such as ball, shepherd, single and double-wheel attachments to the legs of the chair to enable the user of such chair to glide it to a desired position while the user is seated in the chair or out of the chair. While the various types of gliding devices, such as the previously mentioned casters, impart mobility to the chair and its user on hard and smooth surfaces, such as wood, linoleum, tile, etc. a user often has a much more difficult time gliding the chair to a desired position when the chair rests on nonsmooth surfaces, such as padded or moderately piled carpeting.

In a substantial number of offices and homes today, carpeting is no longer looked upon as a luxury but rather as a necessity in terms of decoration and comfort. Once a conventional gliding chair is placed upon carpeting, it is often found that its ability to be glided about in a facilitated manner is extremely decreased. Depending on the pile and type of carpeting, as well as the thickness of the padding underneath, the mobility of such an otherwise easily mobile chair to be glided can be lost. Additionally, the utilization of a conventional three or four-wheeled caster chair often has a tendency to deface the carpeting through the continuous application of substantial weight, causing the gliding devices to embed into the nap of the carpet. Further, once a gliding device is embedded into the carpet, attempts at moving the chair with substantial weight in it, results in the placement of undue sheer forces on the casters or wheel assemblies, often resulting in damage to these gliding devices, thus requiring additional expense for their repair or replacement.

The most universal, conventional solution to the problems arising under the placement of an otherwise mobile chair on carpeting has been through the use of chair mats, often fabricated of plastic and vinyl. While the use of chair mats reduces the amount of sheer force exerted on a chair's caster assemblies, a series of problems are often encountered which tend to make them undesirable. Among these problems is the additional cost required for supplying these articles to enable mobility of the chair, the relatively frequent cracking and fracturing of the mats, and the substantially unattractive effect these mats impart to an otherwise attractively carpeted area. Even though these mats are available in a variety of colors, it is extremely difficult to coordinate mat colors, designs, etc. with the overall decorating scheme in the home or office.

Even more importantly, however, several serious structural problems arise when one attempts to utilize the conventional mobile or gliding chair assembly on such a mat. The first of these problems is the fact that the size of the mat is often limited, thereby enabling mobility of the gliding chair to only a particular, somewhat constrained, rolling region. Secondly, the mats themselves are constructed of a substantially thick material so as to reduce cracking, splitting and deformation by the chair's rolling devices. In most conventional mats, for example, the thickness often approaches 3/16ths of an inch. A problem arises when a rolling or gliding caster device goes beyond the limits of the region protected or defined by the mat, the user must apply sufficient body momentum to the chair to roll that particular caster back onto the mat. Where the casters or rolling devices utilized are of such a small diameter and dimension, the user often finds himself having to get out of the chair and lifting the chair itself and the legs and gliding device that slipped off the mat back onto the mat. Where the gliding devices are of such a dimension so as to enable rolling back onto the mat once it has rolled off, it is necessary for the user to exert a substantial amount of force to recover the chair's original placement with all of its gliding devices on the mat. While overly inconvenient to the user, the re-positioning of the chair, its legs, and its associated rolling devices, often places extreme stress on the caster devices, thereby frustrating the overall purpose of the mat and causing even more damage to the casters than would have been encountered had there been no mat utilized in the first place. In accordance with this problem, it becomes apparent that replacement and repair of the caster assemblies themselves or the upwardly extending member from the casters which attach them to the legs of the chair, can be encountered. To emphasize the effects of the mat edge to the chair's casters it should be noted that many office furniture manufacturers actually test the rigidity and dependability of the casters they use through tests wherein casters are repeatedly glided over the edge of a mat under a loaded force.

It is thus an object of the present invention to provide an improved gliding chair system which automatically distributes the weight of the user and the chair as desired through a number of supporting, gliding devices and which does so automatically through the basic concepts of fulcrum and lever.

It is additionally an object of the present invention to provide a mobile chair for a user which is unobtrusive to the eye and which eliminates the need for the supply and usage of smooth hard mat surfaces.

It is also an object of the present invention to provide a chair assembly which can be glided to a desired position outside the normal range of a conventional mat, which decreases the damage to carpeting while still imparting relatively easy gliding characteristics to the chair for the user.

Further, it is an object of the present invention to provide a mobile chair which can be adjusted from a structural configuration for use on carpets to the more conventional gliding structure utilized on conventional chairs for use on hard, smooth surfaces, one which is reasonably inexpensive to fabricate and one which uses gliding devices which are less costly to manufacture while at the same time providing an effective alternative to the more costly caster devices utilized on more conventional chairs.

These and other objects of the invention will become apparent in light of the following disclosure.

SUMMARY OF THE INVENTION

The present invention is an improved gliding chair system which utilizes elevated sitting means for receiving a user's body. Chair support means are attached to and cooperate with the lower end of these sitting means and provide support and elevation to the sitting means, as well as the means for mobility to the overall gliding chair system.

The chair support means comprises a plurality of extended leg members, as well as one or more double-action lever devices rotatably connected at a fulcrum point along one or more of the plurality of extended leg members. Each one of the one or more double-action lever devices has outer gliding means attached by glide-attachment means, proximate to a first end of the lever means and inner gliding means cooperating with a second end of the lever means directly opposite the first end. Each of the one or more double-action lever means rotates about the fulcrum connection and the extended leg member so as to distribute the weight of the user's body and the chair system itself through both the inner and outer gliding means, thereby reducing the force exerted by the user in the chair at any one point on the surface, and facilitating the gliding of the chair over the surface.

In a preferred embodiment of the invention, the fulcrum connection comprises each of the one or more double-action lever means pinned to each of the one or more extended leg members respectively. In this embodiment, each of the one or more leg members utilized with the lever means have a flanged construction with the second end of each of the lever means respectively positioned within this flanged construction.

In this preferred embodiment of the outer gliding means comprises an outer caster assembly which is attached in a rotatable offset manner to the first end of the lever means by glide attachment means. In yet another embodiment of the invention, the outer gliding means comprises outer satellite glides which have a substantially disc-shaped curvilinear lower surface and which are attached in a rotatable offset manner to the first end of the lever means by comparable glide attachment means.

The gliding attachment means which may be utilized to attach either the inner or outer glide means, depending upon the type of glide means utilized, comprises an upwardly protruding member extending from an offset position about the glide means towards and into the lever means, about which it is rotatably attached.

In yet another embodiment of the invention, the inner gliding means comprises a common master glide attached to the chair support means so at to telescope downwardly therefrom. The master glide has a substantially disc-shaped curvilinear lower surface and has an upper surface which extends radially to a position directly below the second ends of the one or more lever means respectively. Thus, when the one or more lever means are loaded under the weight of the chair system and user, they collectively distribute a portion of the chair and user weight through their respective second ends to the common master glide which, in turn, telescopes downwardly to distribute the weight to a substantial surface area upon which the gliding chair system glides.

In yet another embodiment of the invention, the inner gliding means comprises one or more inner satellite glide means, each having a substantially disc-shaped curvilinear lower surface, which cooperate with the second end of each of the one or more levers through the previously discussed rotatably attached glide attachment means. Similarly, the inner gliding means may also comprise one or more inner caster assemblies which cooperate with the second end of the lever in an equivalent fashion through the rotatably attached offset glide attachment means.

In the preferred embodiment of the invention, the lever means has a plurality of lever orifices therethrough so as to enable adjustment of the location of the fulcrum connection relative to the lever which thereby enables the variation and adjustment of weight distribution between the inner and outer gliding means. Further, in this preferred embodiment the extended leg members have a plurality of leg apertures therethrough which align with these lever orifices. Thus a user is capable of fixedly restraining the attachment of the orificed lever means to the extended leg thereby enabling conversion of the present gliding chair system to a conventional gliding chair apparatus. Accordingly, the inner guide means, for example, could be retracted from contact with the surface with the chair utilizing only outer guide means. Such a retraction feature would be desirable to avoid damaging the various types of glides usable with the invention when moving the chair in shipment or over a non-carpeted area.

The previously discussed chair support means cooperate with the lower end of the sitting means through seat elevation means comprising an extension pedestal attached to and cooperating with the lower end of the sitting means. In the preferred embodiment of the invention, additionally, the seat elevation pedestal further comprises means for swivelling, thereby enabling the repositioning of the chair support means relative to the sitting means.

As can be easily realized, the inner glide means on the gliding chair system can further be camouflaged by enclosing these guide means by a cowling under the sitting means.

BRIEF DESCRIPTION OF THE DRAWINGS

FIG. 4 is a side elevational view of the invention thereof particularly illustrating the utilization of an inner common master glide;

FIG. 5 is a side elevational view of the present invention of another embodiment utilizing an inner common master glide and outer satellite glides;

FIG. 6 is a side elevational view of a portion of the chair support means which utilizes both inner and outer satellite glide means and which shows lever means constructed to coincide with the edges of the leg means;

FIG. 7 is a side elevational view of a lever means with lever orifices therethrough;

FIG. 8 is a side elevational view of an extended leg having leg apertures fabricated therethrough;

FIG. 9 is a side elevational view of the present invention showing utilization of a satellite glide and caster assembly for the inner and outer glide means respectively; and FIG. 10 is a side elevational view of a caster and satellite glide assembly for the inner and outer glide means respectively.

DETAILED DESCRIPTION OF THE DRAWINGS

Figure 1:
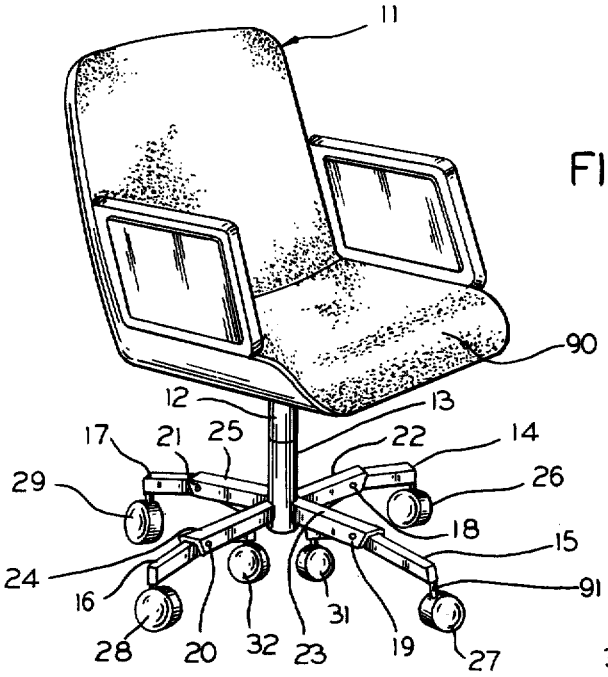
FIG. 1 is a side perspective view of the gliding chair system showing, in particular, the inventive chair support means used therewith.

While this invention is susceptable of embodiment in many different forms, there is shown in the drawings and will herein be described in detail several specific embodiments with the understanding that the present disclosure is to be considered as an exemplification of the principles of the invention and is not intended to limit the invention to the embodiments illustrated.

FIG. 1 of the drawings illustrates gliding chair system 11 comprising sitting means 90 and chair support means 13 which in the preferred embodiment of the invention includes elevation means 12. In this particular embodiment extended legs 22 through 25 are each fabricated in the shape of a channel. Lever means 14 through 17 have their innermost sides positioned within legs 22 through 25 respectively. Further, lever means 14 through 17 are rotatably attached and pinned at points 18 through 21 respectively. On the outermost or first side of lever means 14 through 17 are glide means 26 through 29 respectively, each maintained in place through glide attachment means such as glide attachment means 91. On the innermost or second end of lever means 14 through 17, are located glide means 30 (not shown), 31, 32 and 33 (not shown). As can be seen by the illustration, the force exerted in sitting means 90 is transferred through elevation means 12 to pinned points 18 through 21 and legs 22 through 25 respectively. The weight force is then transmitted to outer and inner guide means 26 through 29 and 30 through 33 respectively. Obviously, if the moment arm from the pinned point on each respective lever is equidistant between the outer glide means and the inner glide means, the weight of the chair and user will be transmitted equally on this particular lever between the inner and outer glide means. Thus, by changing the moment arm or distance between the pinned fulcrum point, such as fulcrum points 18 through 21 and their respective inner and outer glide means, the weight distribution between the inner and outer glide means can be easily modified.

Figure 2:
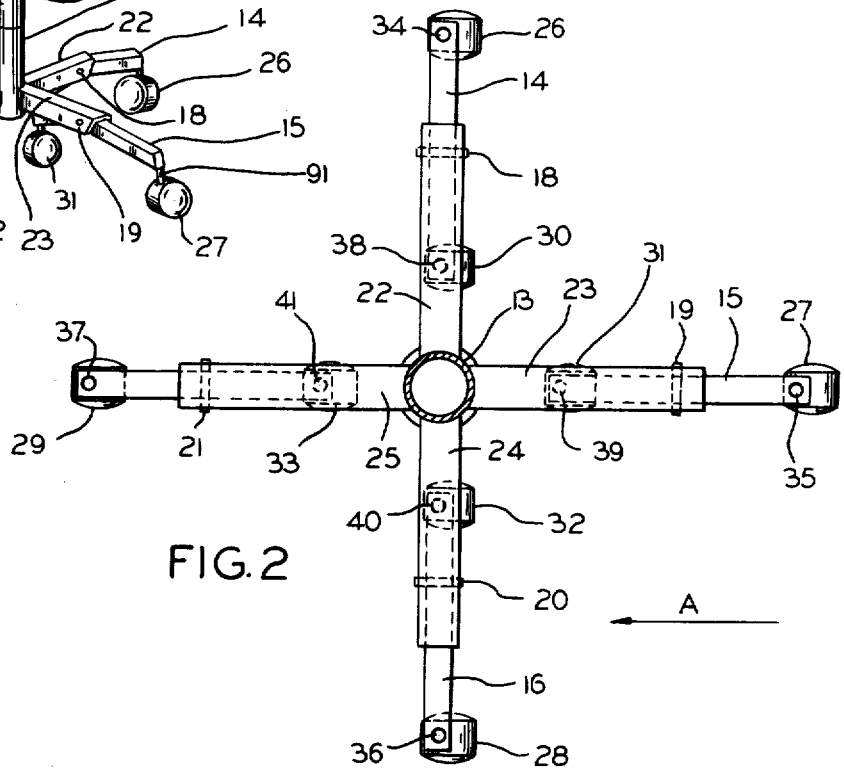
FIG. 2 is a top view of a chair support means of the present invention showing, in particular, one embodiment wherein the chair is being glided in the direction designated by A.

The top view of chair support means 13 as shown in FIG. 2 further illustrates extended legs 22 through 25, associated lever means 14 through 17, and pinned fulcrum points 18 through 21 respectively. Also shown are outer glide means 26 through 29 which in this embodiment comprise conventional casters, inner glide means 30 through 33 and which in this embodiment also comprise caster assemblies and caster glide attachment points 34 through 37 for the outer glide means and 38 through 41 for the inner glide means respectively. Glide means 26 through 29 and 30 through 33 are shown in a position taken as chair support means 13, is mobilized in the direction indicated by A.

Figure 3:
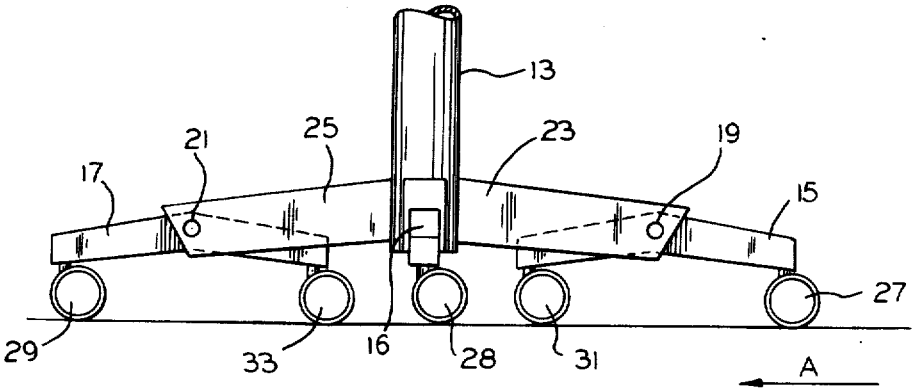
FIG. 3 is a side elevational view of chair support means of the present invention, illustrating the same embodiment illustrated in FIG. 2 under movement of the direction designated by A.

A side elevational view of the overall chair support means 13 as shown in FIG. 2 is illustrated in FIG. 3 wherein outer glide means 27, 28 and 29, inner glide means 31 and 33, and lever means 15, 16 and 17 are shown respectively. Pin points 19, 20 (not shown) and 21 maintain lever means 15 through 17 in place rotatably within channelled legs 23, 24 (not shown) and 25.

Another embodiment of the invention as shown in FIG. 4 wherein the inner glide means comprises master glide 42 which depends from telescoping member 43 within chair support means 44. Lever means 46 is shown to exemplify the manner in which outer glide means 48 and master glide 42 distribute the weight from lever means 46 onto the surface upon which the gliding chair invention is placed and utilized.

FIG. 5 of the drawings illustrates chair support means 44 having leg 47 as well as lever means 46 pinned at fulcrum 45. In this embodiment, however, satellite glides 49, 50 and 51 are utilized in the place of caster assemblies to provide an alternative inexpensive gliding device for use on carpeted areas, for example. In this particular embodiment, the outer gliding means, comprising satellite glides 49, 50 and 51, are used in combination with an inner gliding means comprising a common master glide 42, telescoping at 43 from chair support means 44 for the purpose of distributing the weight placed upon the chair as well as the weight of the chair itself.

Yet another embodiment is shown in FIG. 6 wherein lever means 57 has a portion **57*b* within the channel construction of leg 58 and 57*a* exposed outside of leg 58. The purpose of such a construction is to provide a clean, integral construction look to leg 58 which blends in with the first end of the lever means 57*a* and to reduce the exposed edges inherent with the previously discussed construction. In this particular embodiment, satellite glides 56 and 54 are used as outer gliding means and satellite glides, such as satellite glide 55,** are used for inner gliding means.

In the preferred embodiment of the invention, the lever means 60 as shown in FIG. 7 has lever orifices 61 through 65 fabricated therethrough so as to enable the utilization of any one of a number of different fulcrum points for lever means 60. Thus, when lever means 60 is utilized, and lever orifice 61 is rotatably attached into an extending leg, as long as orifice 63 is half-way between glide means 67 and 66, the weight will be equally distributed between the two glide means. However, the use of orifices 61, 62, 63, 64 and 65 are available so as to adjust the weight distribution between outer glide means 66 and inner glide means 67. When used in conjunction with leg 69 of FIG. 8 a further advantage is provided for the user. Leg apertures 70 through 73 in leg 69 of chair support means 68 enables the fixed restraint of lever means 60 of FIG. 7 through the utilization of two or more fastening devices. Accordingly, if the user of the present invention were to desire use of the invention on a conventional hard, smooth surface or floor, for example, utilizing the outer gliding means, he need only fasten lever means 60 into standard leg 69 with inner glide means 67 retracted out of contact with the floor surface. This retraction feature can similarly be used to prevent damage to either set of glide means during shipping or transfer of the chair.

Two additional embodiments of the invention are shown in FIGS. 9 and 10 in which leg 74 is utilized with lever means 75 through rotatable fulcrum 76. FIG. 9 of the drawings illustrates the utilization of satellite glide means 78 for the inner glide means, and caster 77 for the outer glide means. Conversely, FIG. 10 of the drawings illustrates caster 80 in use as the inner gliding means and satellite glide 79 functioning as the outer gliding means on the gliding chair invention.

The foregoing description and drawings merely illustrate and explain the invention and the invention is not limited thereto, except insofar as the appended claims are so limited, as those skilled in the art who have the disclosure before them will be able to make modifications and variations therein without departing from the scope of the invention.

What is claimed is:

1. An improved gliding chair system comprising:
elevated sitting means for receiving a user's body;
chair support means attached to and cooperating with the lower end of said sitting means for providing support and means for mobility to said gliding chair system,
said chair support means comprising a plurality of extended leg members,
said chair support means further comprising one or more double-action lever means rotatably connected for movement in a vertical plane at a fulcrum point located a desired distance along one or more of said plurality of extended leg members respectively,
each of said lever means maintained in a fixed protruding position relative to said leg member so as to be in substantial alignment with said respective leg member whereby rotative movement of said lever means relative to said respective leg member in a substantially horizontal plane is precluded,
each of said one or more double-action lever means having outer gliding means attached by glide attachment means proximate to a first end of said lever means and inner gliding means cooperating with a second end of said lever means, and
each of said one or more double-action lever means rotating about said fulcrum connection in said extended leg member so as to distribute the weight of said user's body and said chair system through both said inner and outer gliding means, thereby reducing the force exerted by said user and chair at any one point on a surface and facilitating the gliding of said chair over said surface.

2. The invention according to claim 1 in which said fulcrum connection comprises each of said one or more double-action lever means pinned to each of said one or more of said plurality of extended leg members respectively for pivotable movement in said vertical plane;
each of said one or more leg members having a channelled construction with said second end of each said one or more lever means respectively positioned within said channelled construction to maintain said lever means in said aligned position relative to said respective leg member.

3. The invention according to claim 1 in which said outer gliding means comprises an outer caster assembly;
said outer caster assembly attached in a rotatable offset manner to said first end of said lever means by said glide attachment means.

4. The invention according to claim 1 in which said outer gliding means comprises outer satellite glide means;
said outer satellite glide means having a substantially disc-shaped curvilinear lower surface; and
said outer satellite glide means attached in a rotatable offset manner to said first end of said lever means by said glide attachment means.

5. The invention according to claim 1 in which said first end of said lever means is contoured in shape to closely approximate the shape of said respective leg member at the area from which said lever means protrudes to eliminate exposed edges in said gliding chair system to, in turn, preclude the inadvertent snagging of a user's clothing or other articles at said area.

6. The invention according to claim 1 in which said glide attachment means comprises an upwardly protruding member extending from an offset position about said glide means towards an into said lever means about which it is rotatably attached.

7. The invention according to claim 6 in which said inner gliding means comprises one or more inner satellite glide means;
each said inner satellite glide means having a substantially disc-shaped curvilinear lower surface;
said inner satellite glide means cooperating with said second end of said lever through said offset rotatably attached glide attachment means.

8. The invention according to claim 6 in which said inner glide means comprises one or more inner caster assemblies;
said inner caster assembly cooperating with said second end of said lever through said offset rotatably attached glide attachment means.

9. The invention according to claim 1 in which said one or more lever means has a plurality of lever orifices therethrough to enable adjustment of the location of said fulcrum connection, thereby enabling the variation and adjustment of weight distribution between said inner and outer gliding means.

10. The invention according to claim 9 in which said one or more extended leg members having a plurality of leg apertures therethrough which align with said lever orifices to enable the fixedly restrained attachment of said orificed lever means to said extended leg, thereby enabling conversion of said gliding chair system to a conventional gliding chair apparatus.

11. The invention according to claim 1 wherein said chair support means cooperates with the lower end of said sitting means through seat elevation means;
said seat elevation means comprising an extension pedestal attaching to and cooperating with said lower end of said sitting means.

12. The invention of claim 11 wherein said seat elevation pedestal further comprises means for swivelling, thereby enabling the repositioning of said chair support means relative to said sitting means.

13. An improved gliding chair system comprising:
elevated sitting means for receiving a user's body;
chair support means attached to and cooperating with the lower end of said sitting means for providing support and means for mobility to said gliding chair system,
said chair support means comprising a plurality of extended leg members,
said chair support means further comprising one or more double-action lever means rotatably connected at a fulcrum point located at a desired distance along one or more of said plurality of extended leg members respectively,
each of said one or more double-action lever means having outer gliding means attached by glide attachment means proximate to a first end of said lever means and inner gliding means cooperating with a second end of said lever means;
each of said one or more double-action lever means rotating about said fulcrum connection in said extended leg member so as to distribute the weight of said user's body and said chair system through both said inner and outer gliding means, thereby reducing the force extended by said user and chair at any one point on a surface and facilitating the gliding of said chair over said surface;
said inner gliding means comprising a common master glide attached to said chair support means so as to telescope downwardly therefrom;

said master glide having a substantially discshaped curvilinear lower surface;

said master glide having an upper surface extending radially to a position directly below said second ends of said one or more lever means respectively; and said one or more lever means collectively distributing a portion of said chair and user weight through said respective second ends to said common master glide which, in turn, telescopes downwardly to distribute said weight to said surface.

* * * * *